US006364724B1

(12) United States Patent
Nozawa et al.

(10) Patent No.: US 6,364,724 B1
(45) Date of Patent: Apr. 2, 2002

(54) GROMMET ASSEMBLY FOR OUTBOARD MOTOR

(75) Inventors: Tomohiro Nozawa; Hiroaki Takase, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/569,229

(22) Filed: May 11, 2000

(30) Foreign Application Priority Data

May 11, 1999 (JP) ..... 11-130667

(51) Int. Cl.[7] ..... B63H 20/32
(52) U.S. Cl. ..... 440/77; 440/113; 277/637
(58) Field of Search ..... 277/636, 637; 403/202; 440/77, 113, 49; 174/152 G

(56) References Cited

U.S. PATENT DOCUMENTS 4,350,372 A * 9/1982 Logsdon ..... 285/45
4,721,405 A * 1/1988 Loberg et al. ..... 403/2
5,183,351 A * 2/1993 Schneider ..... 277/636
5,335,751 A * 8/1994 Kuroki ..... 277/636
5,637,021 A 6/1997 Watanabe

* cited by examiner

*Primary Examiner*—Stephen Avila
(74) *Attorney, Agent, or Firm*—Knobbe, Martens, Olson & Bear, LLP

(57) ABSTRACT

A grommet assembly for an outboard motor includes a grommet having a step, a flexible sleeve having a step and a connector configured to engage the step on the grommet and the step on the flexible sleeve. Preferably, the connector is in the form of an annular connector formed of two semicircular members connected to one another. Additionally, the step formed on the sleeve preferably is defined by a helical groove formed on the flexible sleeve. The connector preferably includes a helical wall defining a step that corresponds to the helical step formed on the flexible sleeve. The grommet assembly may also be in the form of a kit including a grommet having a step and a connector configured to engage the step on the grommet and a step formed on an existing flexible sleeve.

24 Claims, 5 Drawing Sheets

GROMMET ASSEMBLY FOR OUTBOARD MOTOR

PRIORITY INFORMATION

The present application is based on and claims priority to Japanese Patent Application No. 11-130667 filed May 11, 1999, the entire contents of which is hereby expressly incorporated by reference.

BACKGROUND OF THE INVENTION

1. Field of the Invention

The present invention is directed to an outboard drive motor for a watercraft, and in particular, a grommet assembly for the engine cover of the outboard motor drive.

2. Description of Related Art

Outboard motors generally include a powerhead that includes a powering internal combustion engine and a surrounding protective cowling. The cowling is provided around the engine so as to provide a neater appearance, to protect the engine from foreign materials, as well as for aerodynamic considerations. Of course, the protective cowling typically includes a number of apertures. For example, the cowlings of outboard motors typically include at least one air inlet arrangement configured to allow combustion air to enter the protective cowling while preventing or attenuating the influx of water into the protective cowling. Additionally, the protective cowling of outboard motors typically includes an aperture through which a plurality of flexible conduits and cables extend, such as for example, fuel lines, oil lines, throttle control lines, transmission control lines and the like.

Watercraft which use outboard motors as a propulsion device typically include a fuel tank disposed within the hull of the watercraft and a fuel supply line that connects the fuel tank with a fuel system of the engine within the protective cowling of the outboard motor. There may also be a lubrication system which includes a remotely positioned tank and which may require delivery and/or return conduits that pass through the protective cowling. Various bowden wire actuators or other types of flexible transmitters may also be required. For example, throttle and transmission control lines typically extend through the protective cowling for operating the throttle and transmission, respectively. Additionally, battery cable may extend through the grommet to connect the battery with a generator and/or a starter motor.

In all these instances, it is desirable to provide an arrangement wherein the various conduits, transmitters or cables, hereinafter referred to in both the specification and the claims as "flexible conduits," pass through openings in the protective cowling and the cowling openings are sealed. Normally, elastic sealing grommets are employed for this purpose. However, if a separate grommet is provided for each flexible conduit, then the construction becomes rather objectionable in appearance. Furthermore, the use of such plural holes and grommets in the protective cowling gives rise to an objectionable construction and one which is expensive to manufacture and more difficult to service.

For example, it is frequently necessary to disassemble and reassemble the arrangement, and it is difficult to feed these various flexible elements through the grommets, particularly if they are in place in the protective cowling. Frequently, attempts at such installation and removal damage the flexible conduits.

It is also desirable that the flexible conduit, protective cowling, and grommet provide a tight seal to prevent water from inadvertently seeping into the interior of the protective cowling and damaging the conduits and components therein. Desirably, flexible conduits pass through the protective cowling at a forward end of the power head of the outboard of the motor. Thus, the grommet can be subjected to significant impingement of wind during operation of the outboard motor in some applications. Such impingement can carry water into the power head if the grommet does not adequately seal against the flexible conduits.

With reference to FIG. 1, a known grommet assembly is shown. The grommet assembly 2 includes a grommet 4, a flexible sleeve 6, and a band clamp 8. Although not illustrated, the grommet 4 is constructed to be installed through an aperture in an outboard motor cowling. Additionally, the grommet 4 includes a number of longitudinally extending passages forming seals with flexible conduits extending therethrough, as is typical in some outboard motors. Additionally, the flexible conduits extend through the flexible sleeve 6. In order to generate a seal between the flexible sleeve 6 and the grommet 4, the band clamp 8 is tightened. Thus, the sleeve 6 provides further protection for the flexible conduits extending through the grommet 4 and provides additional wind protection for the seal between the grommet 4 and the flexible conduits.

SUMMARY OF THE INVENTION

One aspect of the present invention includes the realization that known grommet assemblies have proved to be inadequate. For example, with reference to FIG. 2, it has been found that where a band clamp is used, such as band clamp 8, to compress the flexible sleeve 6 radially inwardly, in the direction indicated by the arrows A, the grommet 4 is undesirably deformed. It has further been found that users can overtighten the band clamp 8 and deform the grommet 4 to such an extent that the sleeve 6 readily falls off the grommet 4. Additionally, it has been found that if the grommet 4 is constructed of a more rigid material, the connection of the sleeve 6 to the grommet 4 may be improved, but the ability of the grommet 4 to create a seal with the flexible conduits is reduced.

A need therefore exists for a grommet assembly for an engine cover of a marine engine that has an incresead life span. It is desirable that the assembly be less likely to be damaged through user intervention and be simple to manufacture. Additionally, the grommet assembly should be constructed in such a manner that the grommet may be formed of an elastomeric or similar material such that the ability of the grommet to seal with flexible conduits extending therethrough is maintained.

According to another aspect of the invention, a grommet assembly for a marine propulsion unit which has a plurality of flexible conduits extending through an engine cover comprises a flexible grommet having an outer surface and at least one passage extending longitudinally therethrough. The grommet includes first and second open ends and a step disposed on the outer surface between the first and second ends. The assembly also includes a flexible sleeve that has an outer surface and at least one step disposed on the outer surface. A first end of the sleeve is configured to fit over a portion of the grommet between the first end and the step. The assembly also includes a connector having first and second engaging devices, the first engaging device configured to engage the step disposed on the grommet and the second engaging device configured to engage the step disposed on the sleeve. By constructing the grommet assembly with a connector that is configured to engage a step disposed on a grommet and a step disposed on the flexible sleeve, the present grommet assembly provides improved engagement between the grommet and the flexible sleeve.

As noted above, known devices have caused a drawback by relying on the compression of the flexible sleeve against the grommet in order to engage the sleeve with the grommet. However, as noted above with respect to FIG. 2, it has been found that users often overtighten the band 8 used to engage the sleeve 6 with the grommet 4 and thus deform the grommet 4. Such deformation of the grommet 4 eventually leads to loosening and dislodgment of the sleeve 6. Thus, by providing a connector that engages a step disposed on the grommet and the step disposed on the sleeve, the present grommet assembly provides engagement between the sleeve and the grommet without relying solely on a frictional force generated by a radially inward compression of the sleeve against the grommet.

Further aspects, features, and advantages of the present invention will become apparent from the detailed description of the preferred embodiment which follows.

Figure 3:
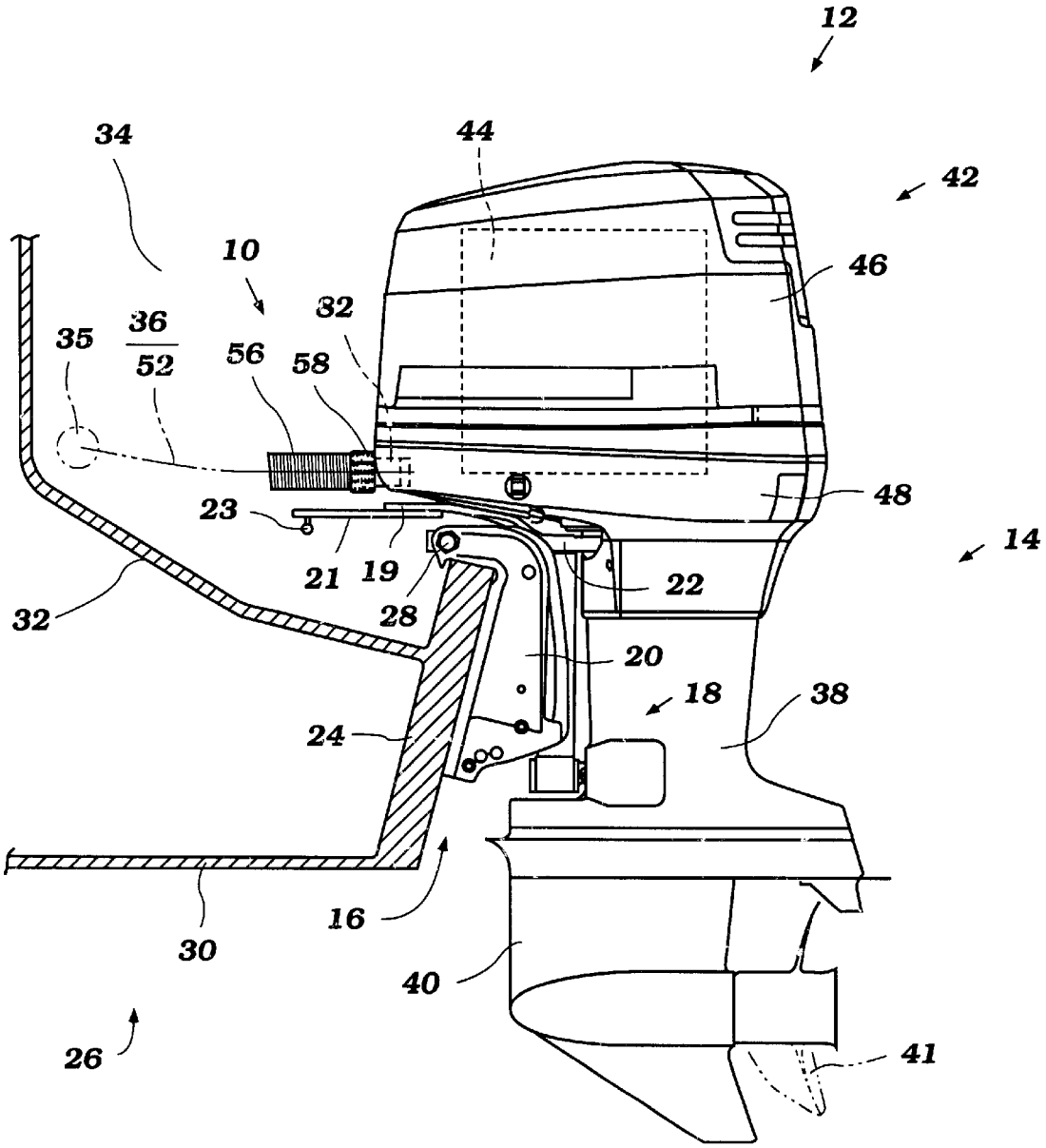
Figure 4:
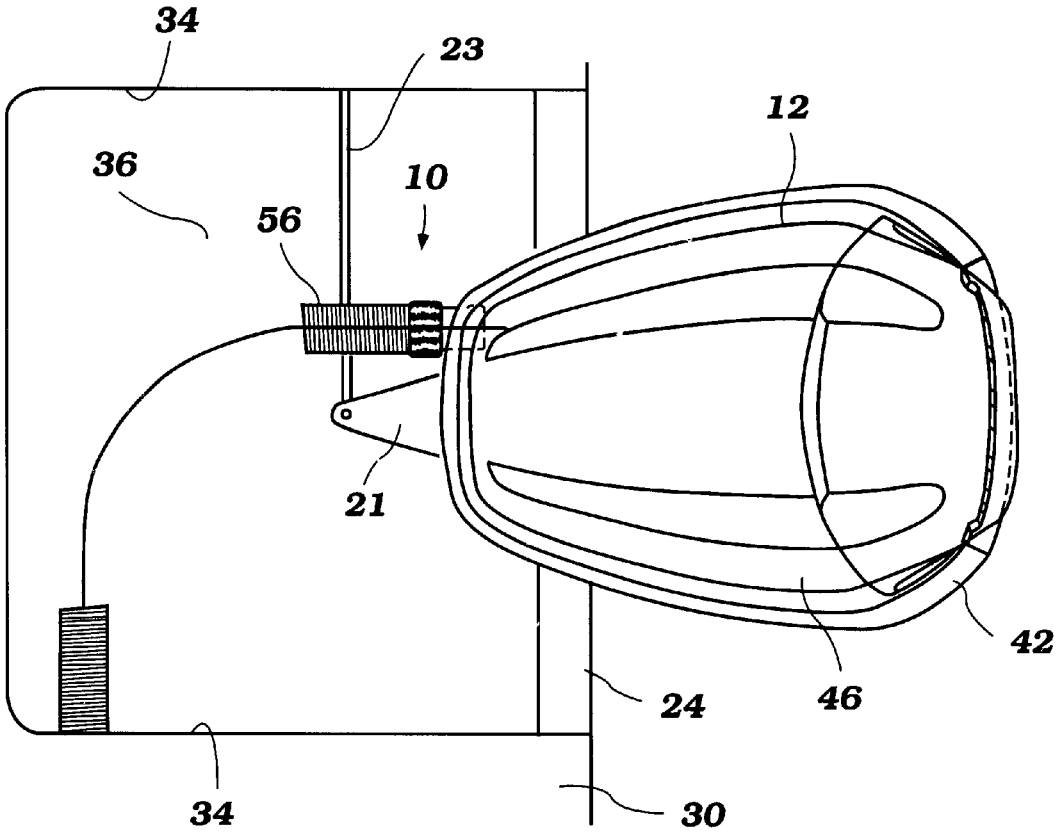
Figure 5:
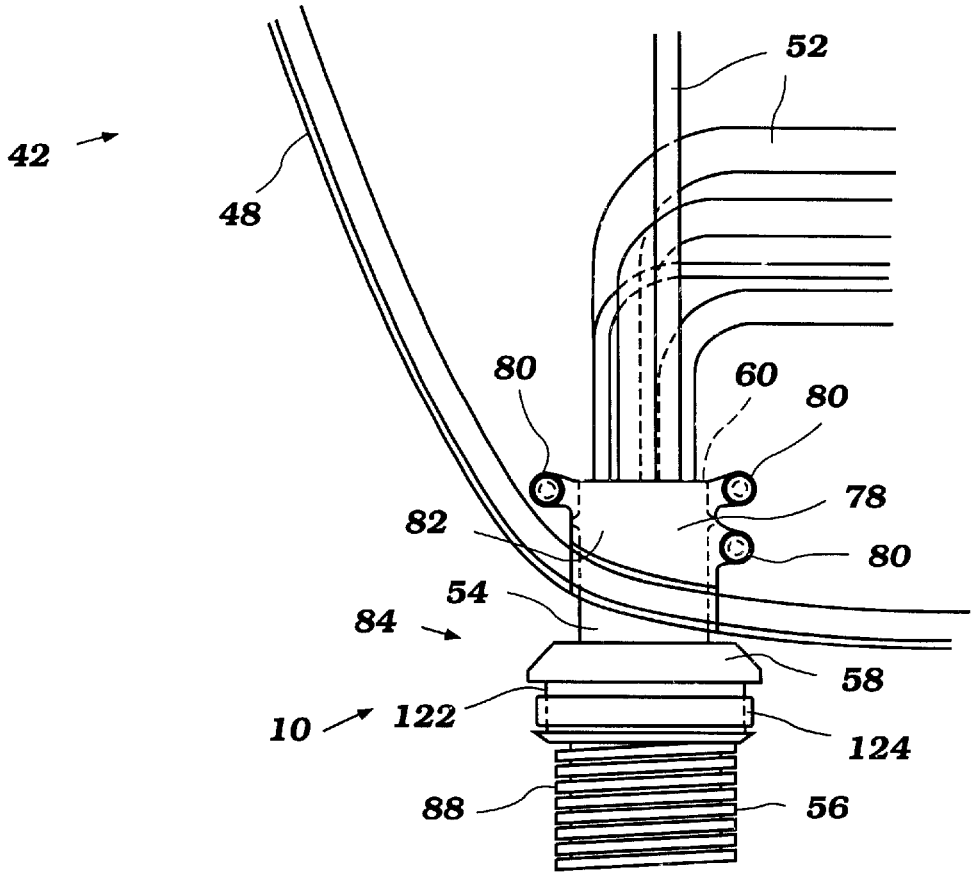
Figure 6:
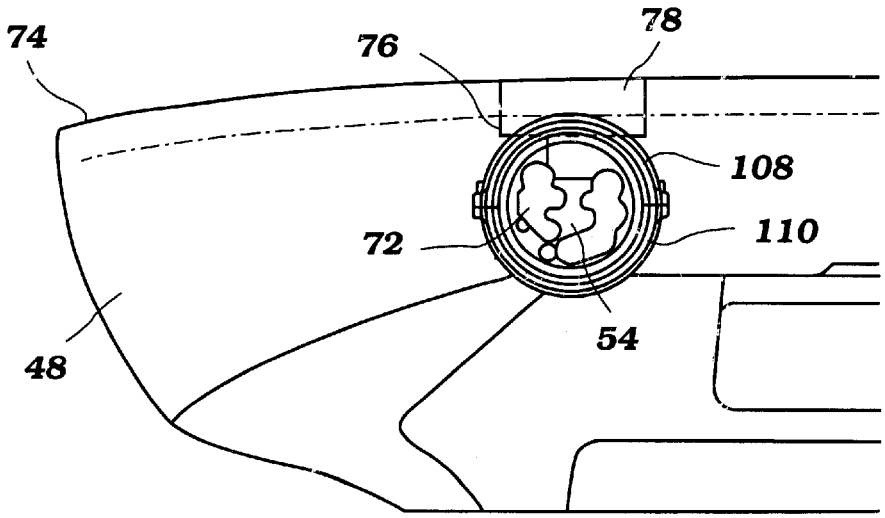
Figure 7:
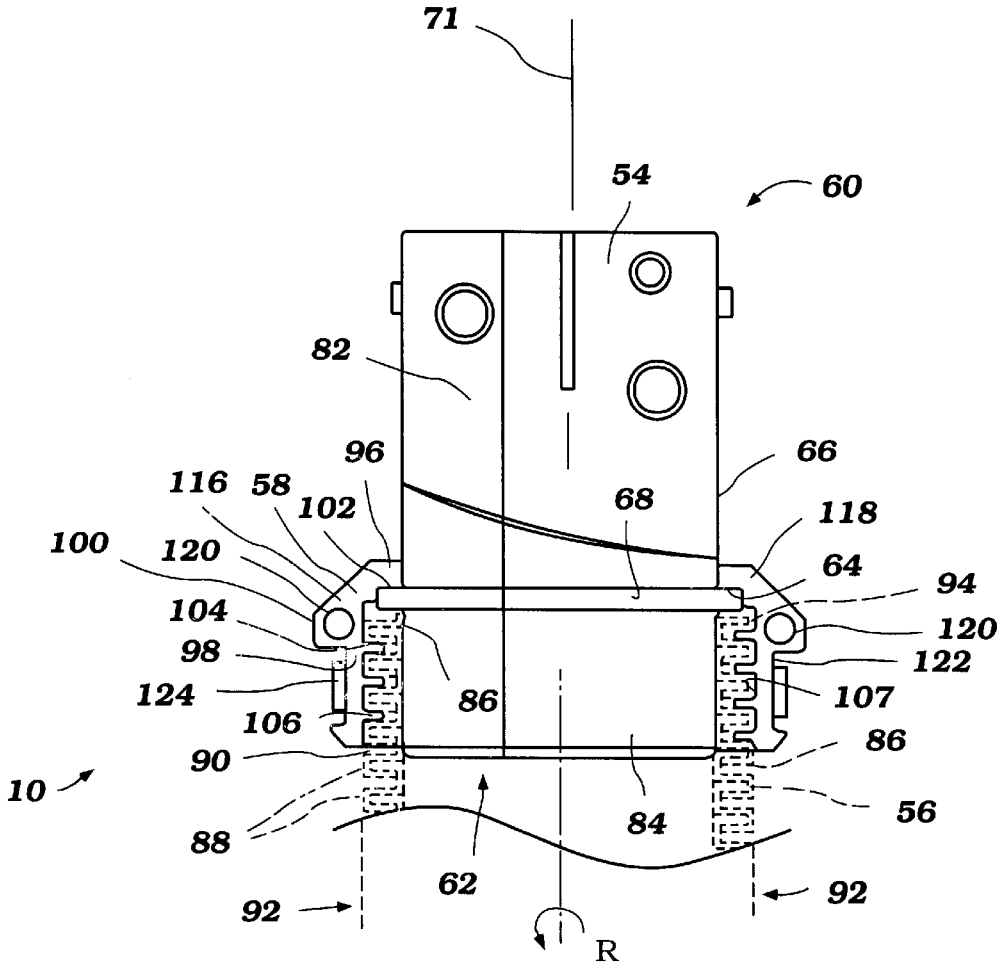
Figure 8:
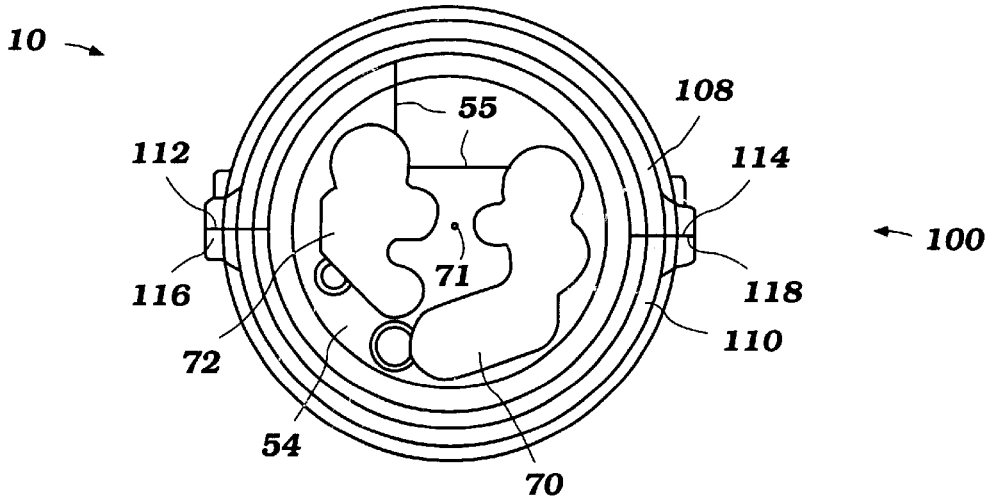

The features mentioned in the Summary of the Invention, as well as other features of the invention will now be described with reference to the drawings of a preferred embodiment of the present grommet assembly. The illustrated embodiment of the grommet assembly is intended to illustrate, but not to limit the invention. The drawings contain the following figures:

FIG. 3 is a side elevational view of an outboard motor having a powerhead which includes a grommet assembly configured in accordance with one aspect of the present invention, the outboard motor being mounted to a transom of a watercraft (shown in section);

FIG. 4 is a top plan view of the outboard motor illustrated in FIG. 3;

FIG. 5 is an enlarged, top plan view of a portion of the outboard motor shown in FIG. 3 with an upper cowling member removed to expose the grommet assembly and a plurality of flexible conduits extending therethrough into an interior of the powerhead of the outboard motor;

FIG. 6 is a front elevational view of the grommet assembly shown in FIG. 5 mounted to a lower cowling (shown partially) of the outboard motor illustrated in FIG. 3;

FIG. 7 is a further enlarged top plan view of the grommet assembly illustrated in FIG. 5, with the flexible sleeve shown in phantom and an upper half of a connector removed; and FIG. 8 is a front elevational view of the grommet assembly illustrated in FIG. 7 with both halves of the connector installed.

DETAILED DESCRIPTION OF THE PREFERRED EMBODIMENTS OF THE INVENTION

An improved grommet assembly for a marine propulsion unit is disclosed herein. The assembly includes an improved structure which provides enhanced engagement between a grommet and a flexible sleeve through which flexible conduits extend. Thus, such flexible conduits are better protected and the water preclusive effects of grommet assembly are enhanced.

With reference to FIG. 3, a grommet assembly 10, which is constructed in accordance with the present invention is illustrated as being attached to an outboard motor 12. The outboard motor 12 provides an exemplifying environment in which the grommet assembly 10 has particular utility. The grommet assembly 10 of the present invention may also find utility in applications in which an internal combustion engine is housed by an engine cover through which at least one flexible conduit extends, such as, for example, but without limitation, personal watercraft, small jet boats, off road vehicles, racing vehicles, and heavy construction equipment.

In the illustrated embodiment, the outboard motor 12 comprises a drive unit 14 and a bracket assembly 16. The bracket assembly 16 comprises a swivel bracket 18 and a clamping bracket 20. The swivel bracket 18 supports the drive unit 14 for pivotal movement about a generally vertically extending pivot shaft 22 which defines a generally vertically extending steering axis. A steering bracket 19 is connected to the drive unit 14, and a steering lever 21 is attached to the steering bracket for allowing the drive unit 14 to be pivoted about the steering axis. In the illustrated embodiment, the steering lever 21 is connected to a steering rod 23. The steering rod 23 preferably is connected to a steering wheel (not shown) so as to allow a user to remotely steer the outboard motor 12.

The clamping bracket 20, is affixed to a transom 24 of an associated watercraft 26 and supports the swivel bracket 18 for pivotal movement about a generally horizontally extending pivot pin 28 which defines a generally horizontally extending pivot axis. A hydraulic tilt system (not shown) can be provided between the swivel bracket 18 and the clamping bracket 20 to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front," and "fore" mean at or to the forward side of the bracket assembly 16, and the terms "rear," reverse," and "rearwardly," mean at or to the opposite side of the front side, unless indicated otherwise.

As shown in FIG. 3, the associated watercraft 26 is a powerboat. The watercraft 26 has a hull 30 that defines a deck (not shown). Additionally, the watercraft 26 includes a wall 32 extending forwardly and upwardly from the transom 24. As shown in FIG. 4, side walls 34 cooperate with the wall 32 to form a transom basin 36 positioned forwardly from the outboard motor 10. An aperture 35 is provided in one of the side walls 34 for allowing a plurality of flexible conduits to extend therethrough and to the outboard motor 12, as discussed below in more detail.

During operation of the watercraft 26, the transom basin 36 may temporarily become partially or totally filled with water. Thus, the wall 32 prevents water from entering the remaining portions of the watercraft 26.

The watercraft 26 may also include any number of seats disposed on the deck. Preferably, the steering wheel, a throttle position actuator (not shown), and a transmission gear position actuator are mounted at an appropriate position on the deck. The steering wheel, the throttle position, and the gear position actuators can be coupled to the outboard motor 12 via a plurality of flexible conduits which extend through the aperture 35, discussed in detail below. One or more of these conduits can comprise fly-by-wire cables connecting the actuators to a steering device that controls the steering rod 23, a throttle valve, or a transmission, discussed in more detail below.

With reference to FIG. 3, the drive unit includes a drive shaft housing 38 and a lower unit 40. The powerhead 42 is disposed atop the drive unit 14 and includes an engine 44, an upper protective cowling 46 and a lower protective cowling 48.

The engine 44 drives a driveshaft (not shown) that extends driveshaft housing 38 and into the lower unit 40. The driveshaft is journaled in any suitable manner. At its lower end, the driveshaft is coupled to a forward, neutral, reverse transmission (not shown).

The transmission, of which the details are not shown, is controlled in a known manner by a shift rod which is journaled for rotatable support in the lower unit 40. The shift rod is connected to a shift cam for actuation of the transmission via a gear position actuator line, in a known manner. The transmission couples the driveshaft to an impeller shaft (not shown) on which a propeller 41 is affixed so as to rotate about a propeller axis in a known manner. The preferred embodiment illustrates an outboard motor with a conventional propeller 41. Nevertheless, any propulsion device can be utilized with the present invention.

The engine 44 can comprise a two-stroke internal combustion engine powering a propulsion device. Preferably, the engine is oriented such that its crankshaft extends along a generally vertically extending axis. The engine may have any number of cylinders and may comprise an inline, V-type, or W-type configuration. Additionally, the engine may operate under other principles of operation (four-cycle, rotary, or diesel principles).

The engine preferably includes an air induction system (not shown) configured to supply air charges to the engine 44. Preferably, a throttle valve (not shown) controls an air charge amount flowing into the engine 44. Preferably, the throttle valve is operated via a throttle cable (not shown) and a nonlinear control mechanism. A throttle cable, in the illustrated embodiment, extends from the engine 44, through the grommet assembly 10, and to the throttle position actuator mounted to the watercraft 26.

The outboard motor 12 also includes a fuel system (not shown) for delivering fuel charges to the engine 44. The fuel system includes a fuel tank (not shown) disposed within the hull 30 of the watercraft 26. A fuel supply conduit extends from the fuel tank, through the aperture 35 and the grommet assembly 10 into the powerhead 42. The fuel supply line is connected to at least one fuel pump for delivering fuel to one or more charge formers (not shown) which are configured to deliver fuel charges to the engine 44.

The outboard motor 12 can also include an oil delivery system which delivers oil from an oil tank to the engine 44. For example, where the engine 44 is a two-cycle type engine, the oil supply system is configured to deliver oil to an oil delivery system of the engine 44. The injector system communicates with the fuel system to introduce oil into the fuel, the induction system, or the crankcase to inject oil into the engine 44. In this embodiment, the oil system comprises an oil tank (not shown) secured to the hull 30 of the watercraft 12. At least one oil supply line extends from the oil tank, through the aperture 35 and the grommet assembly 10 to the induction system or to the crankcase of the engine 44. The oil supply line can be constructed in any manner; however, it is preferably in the form of an oil line commonly used with outboard motors.

The outboard motor 12 also preferably includes an electrical system (not shown). The electrical system preferably includes an alternator (not shown) driven by the engine 44 and a battery (not shown) for storing rectified electrical energy from the alternator and to supply electric power to electrical equipment prior to and during starting of the engine 44. The battery preferably is secured to the hull 30 of the watercraft 26. A flexible electrical conduit extends from the battery, through the aperture 35 and the grommet coupling 10 to the various electrical components of the engine 44. Typically, two electrical conduits will extend between the battery and the engine 44, i.e., the first electrical conduit connected to the positive terminal of the battery and a second electrical conduit connected to the negative terminal of the battery.

The outboard motor 12 also includes an ignition system (not shown) powered by the electrical system. Preferably, the ignition system includes spark plugs (not shown) mounted to the engine 44 for igniting fuel/air mixtures compressed within the engine 44.

Preferably, the outboard motor 12 includes a control system (not shown) for controlling various aspects of the operation of the engine 44. Preferably, the control system is in the form of one or more electronic control units (not shown) configured to control the fuel supply system, the ignition system, lubrication system, and the electrical system based on information collected from various engine sensors (not shown). The sensors utilized by the electronic control units may include, for example, but without limitation, an oxygen sensor, a throttle position sensor, an engine speed sensor, a fuel line pressure sensor, a trim angle sensor, an intake air temperature sensor, an atmospheric pressure sensor, an exhaust back pressure sensor, an engine temperature sensor, an oil pressure sensor, an oil temperature sensor, an intake air pressure sensor, an engine height sensor, a knock sensor, a neutral sensor, a watercraft pitch sensor, a watercraft speed sensor, and an atmospheric temperature sensor. Signal lines also extend through the grommet assembly 10 to connect such sensors with the motor. The electronic control units may use information from the various sensors in order to control ignition timing and fuel control based on various control strategies, as is well known in the art.

The watercraft 26 preferably includes an electrical system or ignition system actuator (not shown) mounted to the hull 30 near the steering wheel. The electrical system/ignition system actuator preferably comprises a lock cylinder which may be unlocked by a key. The actuator is connected to the electrical system or the ECU via at least one electrical conduit. The electrical conduit extends from the actuator, through the aperture 35, and the grommet assembly 10 through the electrical system or the ECU housed within the outboard motor 12. Thus, upon the insertion and rotation of a key into the lock cylinder, a user can initiate the electrical system which may include a starter motor (not shown) and/or the ECU.

The description thus far has been that of an outboard motor but it should be understood that similar arrangements may also be employed with the outboard drive portion of an inboard/outboard drive.

With respect to FIG. 5, a plurality of flexible conduits 52 are illustrated as extending through the grommet assembly 10 into the interior of the powerhead 42. Although not labeled individually, the flexible conduits 52 are intended to represent the various flexible conduits noted above, such as the fuel lines, transmission shift cable, ignition wires, starter motor control wires, electrical conduits extending to the battery, as well as other gauges and sensors which indicate the operational state of the engine 44, mounted in the watercraft (e.g., the gauges can be mounted in proximity to the steering wheel). However, as noted above, these flexible conduits are only examples. Thus, one of ordinary skill in the art will appreciate that the present grommet assembly 10 can be used with any application in which a grommet assembly may be beneficial.

With reference to FIGS. 5–8, the grommet assembly 10 is comprised of an grommet 54, a flexible sleeve 56, and a connector 58. The grommet 54 may be made of a suitable elastomeric, rubber-like material which is resistant to water and particularly salt water. It may be molded in any manner known in the art and is comprised of a body having a first open end 60, a second open end 62, and a step 64 provided on an outer surface 66 between the first and second open ends 60, 62. The step 64, in the illustrated embodiment, is formed on an annular rib 68 which projects radially outwardly from the outer surface 66. Alternatively, the step 64 may comprise an inner wall of a channel (not shown) recessed from the outer surface 66.

As shown in FIG. 8, the grommet 54 is constructed so as to include at least one through hole which extends longitudinally through the grommet 54. In the illustrated embodiment, the grommet 54 includes two through holes 70, 72 extending between the open ends 60, 62 and generally in the direction of a longitudinal axis 71 of the grommet assembly 10. The shape of each through hole 70, 72 is configured to receive, in a tightly spaced manner, the various flexible conduits 52 extending therethrough. For example, certain portions of the through hole 70 may be configured to fit tightly with certain flexible conduits such as the fuel line, the throttle cable, and a wire harness extending to gauges mounted near the steering wheel. Preferably, the grommet 54 is sectioned along cut lines 55 which allow the grommet to be spread open such that the through holes 70, 72 can be opened. As such, the cut lines 55 allow the flexible conduits 52 to be placed into the through holes 70, 72 without having to thread a free end of the conduits 52 through the open ends 60, 62 of the grommet 54. A further detailed explanation of the construction of the through holes 70, 72 is set forth in U.S. Pat. No. 5,637,021, the entire contents of which is hereby expressly incorporated by reference.

With reference to FIG. 6, the lower cowling 48 includes an upper edge 74 that is configured to sealedly engage with the upper cowling 46. A recess 76 is formed in the lower cowling 48 and is open along the upper edge 74. As shown in FIGS. 5 and 6, the grommet 64 is sized so as to fit within the recess 76. Preferably, the recess 76 and the grommet 54 are sized such that the grommet 54 creates a tight fit with the recess 76. Also preferably, the recess 76 and the grommet 54 are shaped so as to provide an anti-rotational engagement between the recess 76 and the grommet 54. For example, the sides of the grommet 54 and the corresponding sides of the recess 76 may be flat and extend generally vertically so as to maintain a desired rotational position of the grommet 54.

The lower cowling 48 also includes a clamping plate 78 which is shaped complementarily to the outer surface 66 of the grommet 54 and to close the open end of the recess 76 above the grommet 54. The clamping plate 78 preferably is securely connected to the lower cowling 48 via a plurality of threaded fasteners 80. Alternatively, the threaded fasteners 80 may be engaged with a further bracket (not shown) which is fixed to the lower cowling 48.

With reference to FIG. 5, the clamping plate 78 fits over a rear portion 82 of the grommet 54 which is adjacent the open end 60. With the grommet 54 installed, as shown in FIG. 5, the rear portion 82 extends into the interior of the lower cowling 48 while a forward portion 84 of the grommet extends forwardly on the exterior of the lower cowling 48.

Upon installation of the grommet 54 to the lower cowling 48, the clamping plate 78 may be tightened so as to compress the grommet 54. Preferably, the clamping plate 78 is tightened to a degree which causes the through hole 70, 72 to at least partially deform to closely follow the outer peripheral surfaces of the flexible conduits 52. Thus, the clamping plate 78 can be tightened so as to provide a substantially watertight seal between the flexible conduits 52 and the grommet 54.

With reference to FIG. 7, the flexible sleeve 56 which is commonly referred to as a "rigging tube," comprises a tubular shaped member and at least one step 86 disposed thereon. In the illustrated embodiment, the flexible sleeve 56 is formed of a corrugated material defining a helical coil 88 having a rectangular cross section. The helical coil 88 defines at least one helical groove 90 which is recessed from an outer peripheral surface 92 of the flexible sleeve 56. A side of the groove 90 defines the step 86 which faces away from the step 64. The flexible sleeve 56 is formed of a single helical coil 88 defining a single helical groove 90. However, it is to be understood by one of ordinary skill in the art that the flexible sleeve 56 could be formed of any number of helical or an individual radially extending flanges e.g., circular or partial circular rib(s)).

As shown in FIG. 7, the flexible sleeve 56 includes an open end 94. As illustrated in FIG. 7, the open end 94 of the flexible sleeve 56 preferably is sized to provide a close fit (e.g., a slip fit) with the outer surface 56 of the forward end 84 of the grommet 54.

With reference to FIG. 7, the connector 58 includes a first engagement device 96 and a second engagement device 98 for connecting the step 64 disposed on the grommet 54 with the step 86 disposed on the flexible sleeve 56. As shown in FIG. 7, the connector 58 is in the form of an annular body 100 having the first engaging device 96 at a rear end and the second engaging device at a forward end thereof; however, the body can take other shapes. In the illustrated embodiment, the first engaging device 96 is an annular step 102 arranged in opposed relation to the step 64 of the grommet. In the illustrated embodiment, the step 64 and the step 102 are individual annular surfaces extending transverse to the longitudinal axis 71. Thus, the connector 58 and the grommet 54 can rotate independently of each other with the step 102 and the step 64 in sliding engagement with each other. However, with the step 102 engaged with the step 64, the connector 58 is restrained from moving forwardly relative to the grommet 54.

As shown in FIG. 7, the second engaging device 98 comprises at least one step 104 that is configured to engage the step 86 formed on the flexible sleeve 56. In the illustrated embodiment, the second engaging device 98 is formed of a helical wall 106 which extends radially inwardly from an inner surface of the connector 58. The shape of the helical wall 106 is complementary to the helical groove 90 such that the step 104 extends into the groove 90 and thus is arranged in opposed relation to the step 86. The helical wall 106 extends through a plurality of turns forming a helical groove 107.

With reference to FIG. 8, the connector 58 preferably is constructed of a split ring construction, i.e., the annular body 100 of the connector 58 is constructed of a first and second semicircular portions 108, 110. As shown in FIG. 8, the first semicircular member 108 has first and second engagement faces 112, 114 and the second semicircular member 110 includes corresponding first and second engaging faces 116, 118. Additionally, the first and second semicircular members 108, 110 include a combination of through holes and/or threaded holes 120 for connecting the first and second semicircular members 108, 110. For example, the second semicircular member 110 includes threaded through holes 120 and the first semicircular member 108 includes straight through holes 120 so as to allow a threaded fastener to extend through the first semicircular member 108 and engage the threaded holes 120 in the second semicircular member 110 to thereby fix the first and second semicircular members 108, 110 together. However, it will be apparent to one of ordinary skill in the art that any suitable connector can be used to connect the fist and second semi-circular members 108, 110 to each other.

With reference to FIG. 7, the connector 58 preferably includes a mounting groove 122 in proximity to the second engaging device 98. As shown in FIG. 7, the mounting groove 122 defines an annular channel extending around an outer periphery of the connector 58 at a position radially outward from at least a portion of the second engaging device 98. In the illustrated embodiment, the mounting groove 122 extends over a substantial portion of the helical wall 106. Thus, with the connector 58 installed, as illustrated in FIG. 7, i.e., connecting the step 64 and the step 86, a band clamp 124 can be mounted around the mounting groove 122 so as to further engage the first and second semicircular members 108, 110 to each other. Additionally, the clamp 124 aids in ensuring engagement between the step 104 and the step 86.

In order to further illustrate the use of the grommet assembly 10, a procedure for installing the grommet assembly 10 is set forth below.

Figure 1:
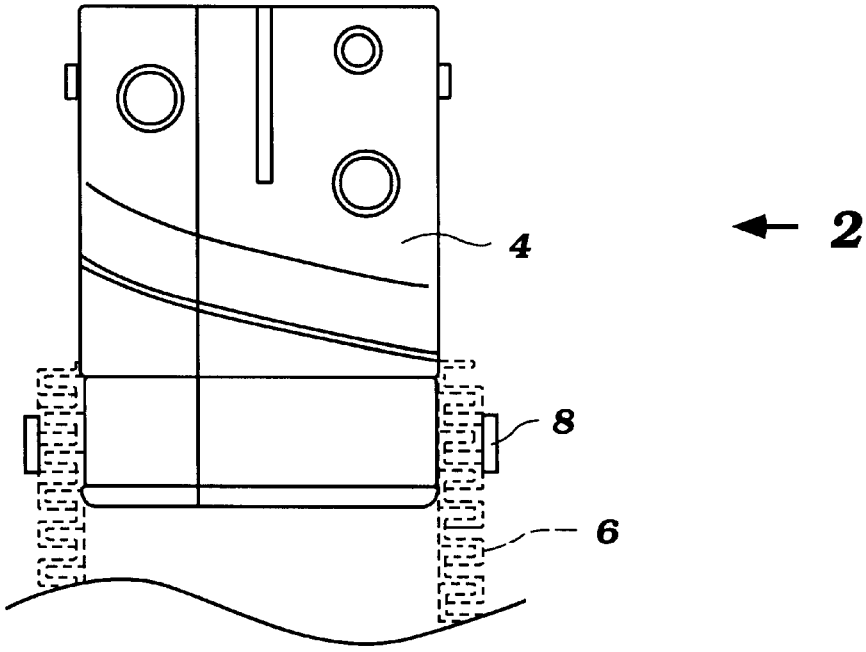
Figure 1 Background Art
FIG. 1 is a top plan view of a known grommet assembly having a flexible sleeve (shown in phantom) attached to a grommet.

With respect to FIGS. 3 and 4, a procedure for installing the grommet assembly 10 begins after the various components of the outboard motor 12 have been properly connected with the various flexible conduits 52 (schematically represented in FIG. 1), which have been previously threaded through the flexible sleeve 56. With the flexible conduits 52 properly connected, the grommet 54 can be opened along the cut lines 55 and the flexible conduits 52 can then be placed within the through holes 70, 72 that may have been opened lengthwise. The proper orientation of the various flexible conduits 52 within the through holes 70, 72 is well known in the art, and thus a further description of such an orientation is not believed to be necessary to one of ordinary skill in the art in light of the disclosure herein.

After the flexible conduits 52 have been arranged within the through holes 70, 72, the grommet is closed and placed within the recess 76 (FIG. 6). As shown in FIG. 5, with the grommet 54 arranged within the recess 76, the clamping plate 78 can be placed over the grommet 54 and secured with threaded fasteners 80. As noted above, the threaded fasteners 80 may be tightened to such an extent that the grommet 54 elastically deforms and thereby creates a reasonably good seal with the flexible conduits 52.

With reference to FIG. 7, the flexible sleeve 56, having been previously installed around the flexible conduits 52, is slid over the forward end 84 of the grommet 54 such that the open end 94 of the flexible sleeve 56 is disposed between the open end 62 and the annular wall 68 of the grommet 54. With the flexible sleeve 56 positioned as such, the first and second semicircular portions 108, 1 10 can be fit over the open end 94 of the flexible sleeve 56 and secured to one another with threaded fasteners extending into the holes 120 disposed outside the lower cowling 48. In positioning the semicircular members 108, 110, the first and second engaging devices 96, 98 should be arranged such that the step 102 is in opposed relation to the step 64 and the step 104 is in opposed relation to the step 86. Preferably, as shown in FIG. 7, a plurality of turns of the connector helical wall 106 engage a corresponding plurality of turns of the flexible sleeve annular groove 90. As such, the connector 58 provides a further enhanced engagement between the grommet 54 and the flexible sleeve 56.

After the connector 58 has been installed as such, a band 24 can be installed around the mounting groove 122 so as to provide a further anchoring effect between the semicircular members 108, 110 and the flexible sleeve 56. Additionally, the clamp 124 further ensures that at least the portion of the step 104 of the connector 58 within the clamp 124 will remain in opposed relation to the step 86 of the flexible sleeve 56, thus ensuring the engagement between the connector 58 and the flexible sleeve 56.

Alternatively, the connector 58 can be installed around the grommet 54 before the sleeve 56 is mated with the forward end 84 of the grommet 54. For example, before the sleeve 56 is slid over the forward portion 84 of the grommet 54, the connector 58 can be assembled around the grommet 54 such that the step 102 is arranged in opposed relation to the step 64. As noted above, threaded fasteners can be used to connect the semicircular members 108, 110 to each other. Also noted above, with the connector 58 assembled as such, the connector 58 can be rotated independently of the grommet 54 despite the sliding engagement of the step 102 with the step 64. Thus, the flexible sleeve 56 can then be introduced and brought into contact with a forward end of the helical wall 106. By turning the connector 58 about the longitudinal axis 71 in the direction indicated by arrow R, the helical wall 106 will follow along the helical groove 90 and thus threadably engage the flexible sleeve 56. By continuing to turn the connector 58 in the direction of arrow R, the flexible sleeve can be moved toward the annular wall 68 until it reaches the position illustrated in FIG. 7. Afterward, the clamp 124 can then be installed as noted above.

Figure 2:
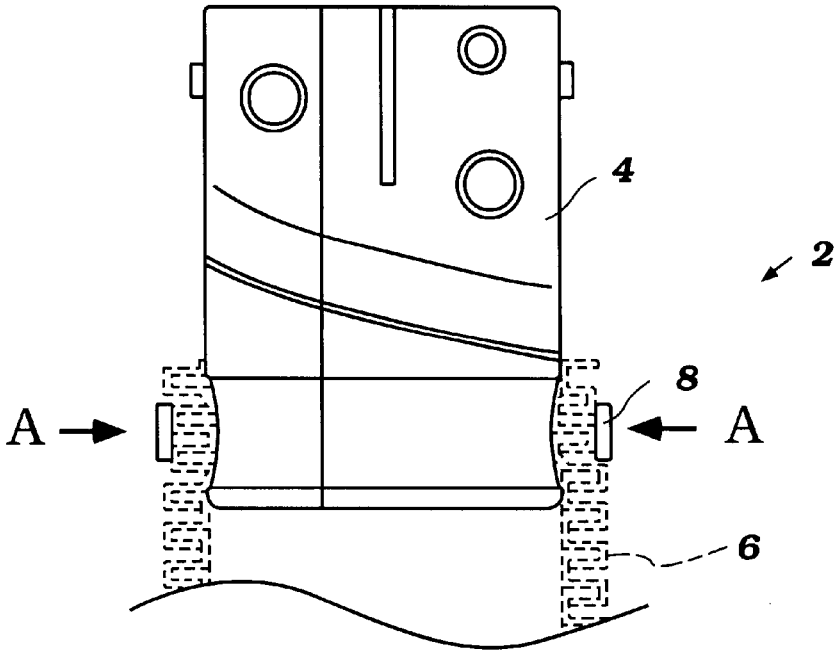
Figure 2 Background Art
FIG. 2 is a top plan view of the grommet assembly illustrated in FIG. 1 with the flexible sleeve being distorted radially inwardly against the grommet.

By constructing the grommet assembly 10 as such, the grommet assembly 10 provides an enhanced connection between the flexible sleeve 56 and the grommet 54. For example, with reference to FIG. 2, it has been found that known grommet assemblies 2 have suffered from the drawback that a band 8 used to compress the flexible sleeve 6 against the grommet 4 is often overtightened and thereby deforms the grommet 4 to such an extent that the flexible sleeve can fall off inadvertently. This drawback is at least partially caused by the construction of known grommet assemblies 2 in relying on a frictional force between the flexible sleeve 6 and an outer surface of the grommet 4.

By constructing the grommet assembly 10 with a connector having first and second engaging devices configured to engage a step disposed on the grommet and a step disposed on the flexible sleeve, the present grommet assembly provides a non-permanent connection between the sleeve 56 and the grommet 54 that does not rely solely on frictional forces between the flexible sleeve 56 and the grommet 54. Rather, the grommet assembly 10 utilizes the engagement of steps formed on the grommet and on the flexible sleeve 56. This is particularly advantageous because the flexible sleeve 56 illustrated in FIG. 7, for example, is commonly used in the industry. Thus, the grommet assembly 10 can be used to replace grommets such as grommet 4 illustrated in FIGS. 1 and 2. In this case, a grommet assembly kit can include the grommet 54 and the connector 58. Purchased as such, a user can conveniently replace an existing grommet, such as the grommet 4 illustrated in FIGS. 1 and 2, and connect the grommet 54 and the connector 58 to an existing flexible sleeve 6.

Of course, the foregoing description is that of certain features, aspects, and advantages of the present invention to which various changes and modifications may be made without departing from the spirit and scope of the present invention. Moreover, the grommet assembly may not feature all objects and advantages discussed above to use certain features, aspects, and advantages of the present invention. Thus, for example, those skilled in the art will recognize that the invention may be embodied or carried out in a manner that achieves or optimizes one advantage or a group of advantages as taught herein without necessarily achieving other objects or advantages as taught or suggested herein. The present invention, therefore, should only be defined by the appended claims.

What is claimed is:

1. A grommet assembly comprising a flexible grommet having an outer surface and at least one through hole extending longitudinally therethrough, the grommet having first and second open ends, a step disposed on the outer surface of the grommet between the first and second ends, a tubular flexible sleeve formed of a helical coil and having an outer surface and at least one helical step disposed on the outer surface, a first end of the sleeve configured to fit over a portion of the grommet between the first end and the step, and a connector having first and second engaging devices, the first engaging device configured to engage the step disposed on the grommet and the second engaging device comprising at least one helical wall configured to engage the helical step formed on the sleeve.

2. The assembly according to claim 1, wherein the connector is more rigid than the grommet.

3. The assembly according to claim 1 in combination with a marine propulsion unit having a plurality of flexible conduits extending through an aperture in an engine cover, the grommet being received within the aperture.

4. The assembly according to claim 1, wherein the sleeve comprises a plurality of annular ridges forming a plurality of annular steps.

5. The assembly according to claim 1, wherein the sleeve defines a substantially water proof tube.

6. The assembly according to claim 1, wherein the grommet comprises an elastomeric material.

7. The assembly according to claim 1, wherein the sleeve comprises a rigging tube.

8. The assembly according to claim 1, wherein the connector comprises an outer surface having a recessed portion disposed radially outward from the second engaging device.

9. A grommet assembly comprising a flexible grommet having an outer surface and at least one through hole extending longitudinally therethrough, the grommet having first and second open ends, a step disposed on the outer surface of the grommet between the first and second ends, a flexible sleeve having an outer surface and at least one step disposed on the outer surface, a first end of the sleeve configured to fit over a portion of the grommet between the first end and the step, and a connector having first and second engaging devices, the first engaging device configured to engage the step disposed on the grommet and the second engaging device configured to engage the step formed on the sleeve, wherein the connector comprises at least two semicircular members.

10. A grommet assembly comprising a flexible grommet having an outer surface and at least one through hole extending longitudinally therethrough, the grommet having first and second open ends, a step disposed on the outer surface of the grommet between the first and second ends, a flexible sleeve having an outer surface and at least one step disposed on the outer surface, a first end of the sleeve configured to fit over a portion of the grommet between the first end and the step, a connector having first and second engaging devices, the first engaging device configured to engage the step disposed on the grommet and the second engaging device configured to engage the step formed on the sleeve, and a band clamp disposed around the connector.

11. An outboard motor comprising a powerhead including an engine and a protective cowling having at least a first aperture, a grommet disposed within the aperture and having an outer surface, a step disposed on the outer surface of the grommet, a flexible tubular sleeve formed of a helical coil having an outer surface and at least a first helical step disposed thereon, a first end of the sleeve being fit over a portion of the grommet, at least one flexible conduit extending through the grommet and the flexible sleeve, and a connector having first and second engaging devices, the first engaging device configured to engage the step disposed on the grommet, the second engaging device comprising at least one helical wall configured to engage the helical step disposed on the sleeve.

12. The outboard motor according to claim 11, wherein the connector is more rigid than the grommet.

13. The outboard motor according to claim 11, wherein the cowling defines an engine compartment, a first portion of the grommet extending into the engine compartment and a second portion of the grommet extending to an exterior of the protective cowling, the step on the grommet being arranged on the second portion of the grommet.

14. The outboard motor according to claim 11, wherein the sleeve comprises a plurality of annular ridges forming a plurality of annular steps.

15. The outboard motor according to claim 11, wherein the connector is constructed of at least two semicircular members.

16. An outboard motor comprising a powerhead including an engine and a protective cowling having at least a first aperture, a grommet disposed within the aperture and having an outer surface, a step disposed on the outer surface of the grommet, a flexible sleeve having an outer surface and at least a first step disposed thereon, a first end of the sleeve being fit over a portion of the grommet, at least one flexible conduit extending through the grommet and the flexible sleeve, a connector having first and second engaging devices, the first engaging device configured to engage the step disposed on the grommet, the second engaging device configured to engage the step disposed on the sleeve, and a band clamp disposed around the connector.

17. The outboard motor according to claim 16, wherein the connector comprises an outer surface having a recessed portion disposed radially outward from the second engaging device, the band clamp being disposed within the recessed portion.

18. A grommet assembly kit comprising a grommet having an outer surface and being configured to be received within an aperture of a cover, the grommet having a first end configured to fit into an open end of a protective sleeve, a step disposed on the outer surface of the grommet, a connector having first and second engaging devices, the first engaging device configured to engage the step disposed on the grommet, the second engaging device comprising an inwardly projecting helical wall configured to engage a step disposed on the protective sleeve.

19. The kit according to claim 18, wherein the connector is more rigid than the grommet.

20. The kit according to claim 18, wherein the connector comprises at least two semi-circular members.

21. The kit according to claim 18, wherein the helical wall is configured to engage a helical groove disposed on a protective sleeve.

22. The kit according to claim 18 additionally comprising a rib projecting radially outward from the outer surface of the grommet, the step being defined by the rib.

23. The kit according to claim 18 additionally comprising at least one through hole extending longitudinally through the grommet, and at least one cut line extending from the outer surface to the at least one through hole of the grommet.

24. An outboard motor comprising a powerhead including an engine and a protective cowling having at least a first aperture, a grommet disposed within the aperture and having an outer surface, a step disposed on the outer surface of the grommet, a flexible sleeve having an outer surface and at least a first step disposed thereon and extending in a generally annular direction along the outer surface, a first end of the sleeve being fit over a portion of the grommet, at least one flexible conduit extending through the grommet and the flexible sleeve, and a connector comprising first and second semi-circular members, the connector also having first and second engaging devices, the first engaging device configured to engage the step disposed on the grommet, the second engaging device comprising at least one wall extending in a generally annular direction and being configured to engage the step disposed on the sleeve.

* * * * *